United States Patent [19]

Ducreuzet

[11] 4,204,603

[45] May 27, 1980

[54] HIGH-CAPACITY CRANE WITH COUNTER-WEIGHT DEVICE

[75] Inventor: Jean Ducreuzet, Saint-Etienne, France

[73] Assignee: Creusot-Loire, Paris, France

[21] Appl. No.: 901,010

[22] Filed: Apr. 27, 1978

[30] Foreign Application Priority Data

Apr. 29, 1977 [FR] France ..... 77 12937

[51] Int. Cl.[2] ..... B66C 23/76

[52] U.S. Cl. ..... 212/49; 180/118

[58] Field of Search ..... 212/48, 49; 414/673, 414/719; 180/115-118

[56] References Cited

U.S. PATENT DOCUMENTS

| | | | |
|---|---|---|---|
| 3,757,699 | 9/1973 | Wirth | 180/118 X |
| 3,842,984 | 10/1974 | Brown et al. | 212/49 |

*Primary Examiner*—Robert G. Sheridan

*Attorney, Agent, or Firm*—Haseltine, Lake & Waters

[57] ABSTRACT

A high capacity crane comprises a structure which is rotatable about a vertical axis on a corner frame supported on the ground and which supports a jib for raising a load and a counter-jib from which is suspended a counter-weight, the counter-weight being connected to the structure, wherein the counter-weight has a mass such that it cannot be raised from the ground by the load but is movable along the ground by means of an air cushion located beneath the counter-weight and connected to a compressed air supply and apparatus for regulating the pressure of the air supplied thereto.

2 Claims, 5 Drawing Figures

HIGH-CAPACITY CRANE WITH COUNTER-WEIGHT DEVICE

The invention relates to a high-capacity crane which possesses, on a carrier frame, a rotatable structure which supports a jib and a counter-jib from which is suspended a balancing counter-weight.

French Pat. No. 2,195,579 discloses a balancing device which makes it possible to increase the capacity of a crane comprising a structure which revolves on a carrier frame and which supports a jib and a counter-jib. This balancing device comprises a balancing carriage which is attached to the counter-jib and which is secured to a circular girder which is anchorer to, or weighed down on, the ground. The carriage can travel on the girder so as to allow the structure, which carries the jib and the counter-jib, to rotate, The unit formed by the girder and by the ballasting counter-weight associated with the carriage is difficult to handle and to shift. Furthermore, when the crane is under load, translational movement of the crane is impossible.

A crane equipped with a balancing device consisting of a counter-weight connected to the revolving structure of the crane by a counter-jib and braces is also known. When the crane is under load, the counter-weight must be released from the ground in order to allow the structure to rotate. It is necessary to adjust the size of the counter-weight to the magnitude of the load raised and to the distance at which the load is situated from the axis of rotation of the structure. In fact, the rotation of the structure makes it necessary to limit the size of the counter-weight in accordance with the load, or the distance of the load, so that the counter-weight is released from the ground. Any particular counter-weight is only suitable within a limited range. It must be possible to vary the mass of the counter-weight in order to embrace the variation in loads for a given jib, and this is not practical, and it is dangerous where, in practice, one would go outside the range envisaged for a particular counter-weight. It can only be achieved by handling heavy weights, which is time-consuming and difficult, and can be dangerous.

A crane equipped with a balancing device consisting of a constant counter-weight equipped with wheels which allow the counter-weight to travel over the ground if the couple of the load is insufficient to release the counter-weight is also known. However, this solution makes it necessary to fix sets of articulated wheels to the towed counter-weight, so as to allow changes of direction, and such sets of wheels are expensive steerable mechanical assemblies. Furthermore, the number of such steerable sets of wheels is necessarily limited because of balancing between sets of wheels, and because the system otherwise becomes too complicated. As a result, the magnitude of the counter-weight is itself limited and does not make it possible to utilise all the possibilities of increasing loads which may offer themselves.

The invention relates to a high-capacity crane equipped with a revolving structure which is mounted on a carrier frame and is associated with a balancing device which consists of a balancing counter-weight of constant mass regardless of the load raised and of the position of this load, movement of the structure being possible even when the crane is under load. The mass of the counter-weight can very largely be selected in order to maintain high stability over the entire spectrum of loads, in accordance with the most unfavourable conditions in respect of the couple applied. However, the counter-weight can be raised from the ground by a variable pneumatic lifting means, so as to permit rotational or translational movement of the structure.

The invention is equally applicable to cranes on caterpillar tracks and to cranes on tyres. In the case of cranes on caterpillar tracks, in particular, it permits the movement of the crane under load.

According to the invention there is provided a high-capacity crane comprising:

a corner frame in contace with the ground;

a structure means mounting said structure on said frame for rotation about a vertical axis;

a jib for raising a load and a counter-jib supported on said frame;

a counter-weight suspended from said counter-jib;

means connecting said counter-weight to said structure;

said counter-weight having a mass such that it cannot be released from the ground by a load suspended from said jib;

air cushion means located beneath said counter-weight; and means for supplying air to said cushion means and for regulating the pressure of air supplied to said air cushion means to permit said counter-weight to be thereby raised from the ground.

The invention will be more fully understood from the following description of an embodiment thereof, given by way of example only, with reference to the accompanying drawings.

Figure 1:
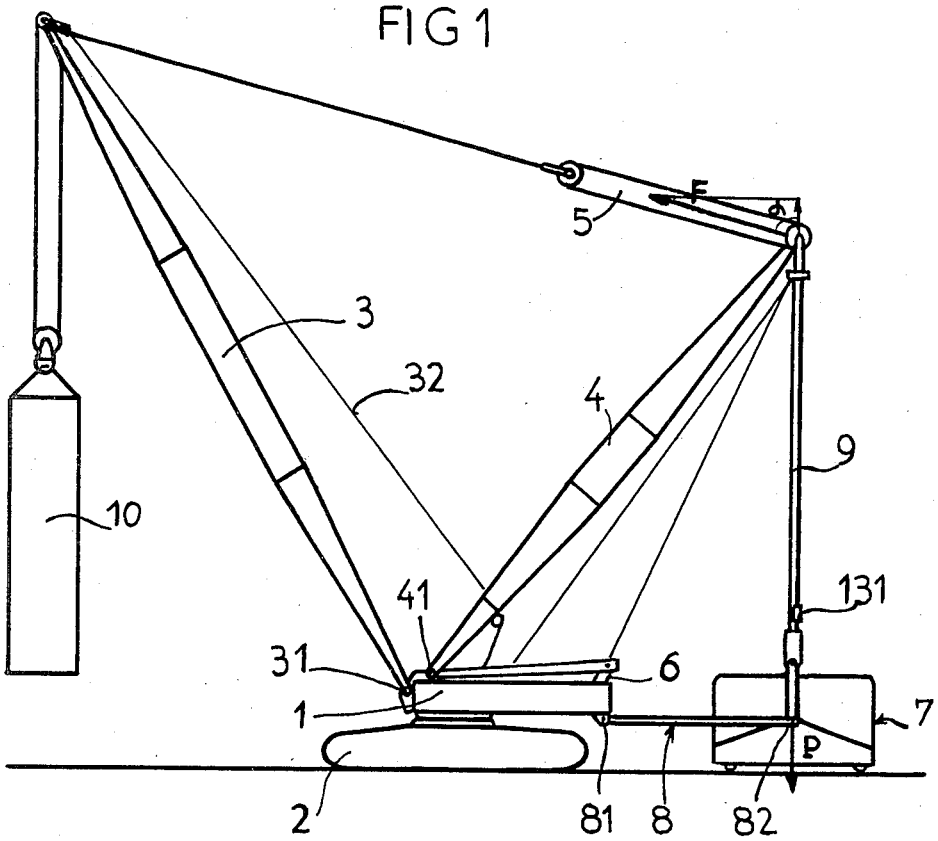
FIG. 1 is an elevation view of an embodiment of a crane equipped with the balancing device according to the invention.
Figure 2:
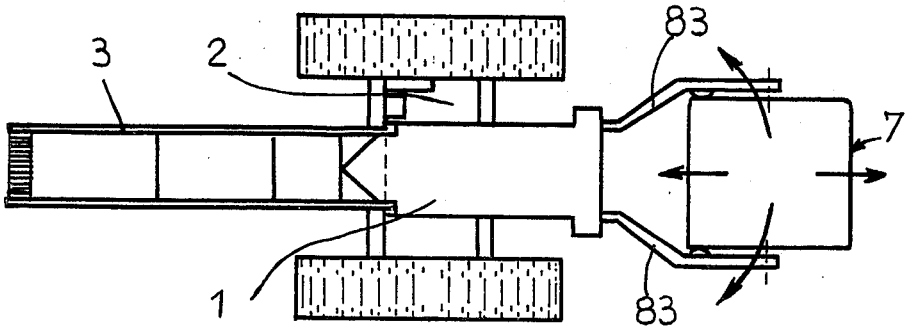
FIG. 2 is a top view of the crane of FIG. 1.

As is shown in particular in FIGS. 1 and 2, the crane comprises a support structure 1 which revolves about a vertical axis on a carrier frame 2.

The carrier frame may be on caterpillar tracks, as is shown in the drawings, but can alternatively be mounted on tires.

The revolving structure 1 is provided with long-reach equipment intended to handle a heavy load 10 at a great distance from structure 1 or at a great height.

This equipment comprises a fixed-frame counter-jib 4 and a jib 3 over which pass the operating cables 32 which serve to raise and lower the load. The jib and the counter-jib can swing on the structure 1 about horizontal axes 31 and 41 respectively. The jib 3 can be of the type which is extensible by adding further units, but it can also consist of a telescopic jib.

A tackle-block 5 joins the upper end of the jib 3 to the upper end of the counter-jib 4. It makes it possible to vary the slope of the jib 3 relative to the counter-jib 4. A tackle-block 6 joins the upper end of the counter-jib to the rear part of the structure 1. It allows the counter-jib to be raised and placed in position.

The crane also comprises a balancing device comprising a counter-weight 7 which is joined to the rear of the structure 1 by connecting frame 8, the frame 8 being articulated about a horizontal axle 81 on the structure and about a horizontal axle 82 on the counter-weight. The counter-weight is suspended from the end of the counter-jib by braces 9.

Figure 3:
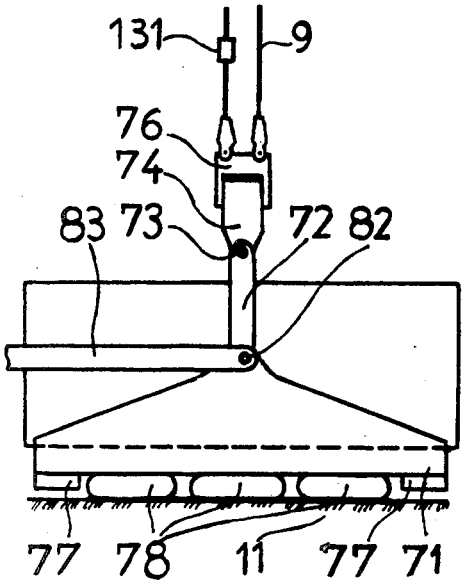
FIG. 3 is a detailed elevation view of the balancing device of the crane of FIG. 1.
Figure 4:
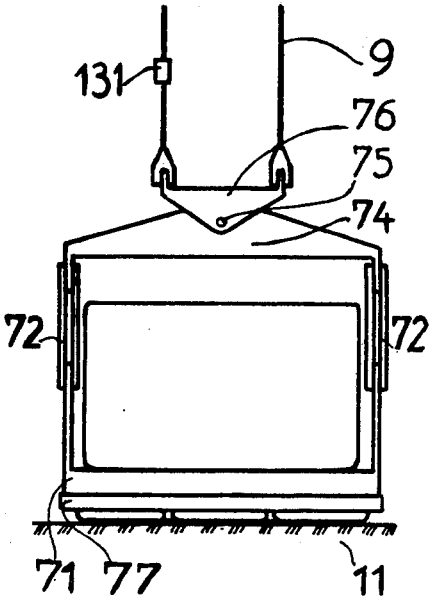
FIG. 4 is a side view of the device shown in FIG. 3.

The counter-weight comprises a platform 71 (FIGS. 3 and 4) equipped with two lateral attachment lugs. On the lateral lugs are articulated, by means of axles 82, lateral arms 83 of the connecting frame 8 as well as link-rods 72 for the attachment of the braces 9. The link-rods 72 are themselves joined by axles 73 to a compensation bar 74 on which is articulated, by means of axle 75, a balancing rocker 76 to which the fixed-length braces 9 are attached.

The platform 71 is located with ballast consisting of metal or concrete blocks or metal plates or any other means of building up a counter-weight so that it is uniformly distributed over the surface of the platform. The total mass of the counter-weight is very largely selected in order to maintain high stability over the entire range of loads raised. The counter-weight can rest on the ground 11 by means of support feet 77 and the mass of the counter-weight is such that the latter cannot of its own accord leave the ground regardless of the manoeuvre carried out. The mass of the counter-weight generates a greater couple, about the axle of articulation 41 of the counter-jib, than the maximum couple generated by the force F applied at the upper end of the counter-jib, about the same axis.

Below the platform 71 air cushions 78 are provided with air supplied by a compressor which is not shown in the drawing. Means for controlling the pressure of the air with which the cushions are supplied are provided.

Figure 5:
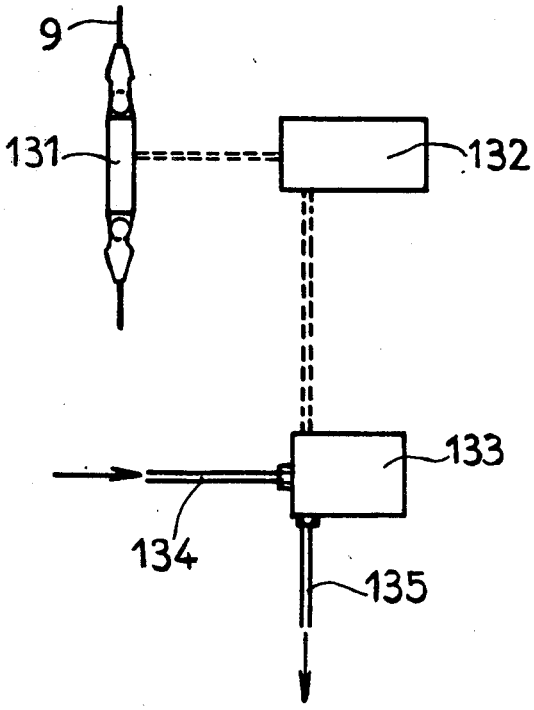
FIG. 5 represents a control circuit for means for feeding the balancing device of FIG. 3 with air.

The diagram of FIG. 5 represents the way in which the pressure of the air cushions is regulated.

A force sensor 131 is provided, for example on the braces 9, which provides an electrical signal which is a function of the load or of any other force proportional to the couple applied to the crane. This signal is amplified by an amplifier 132. The amplifier controls a servo-restrictor 133 which varies the pressure of the air which comes from a compressor connected to line 134 and is passed through line 135 to the pneumatic lifts or cushions 78.

The operations of the crane will now be described.

Initially, that is to say when being set up, the crane is in position with the jib and the counter-jib on the ground, connected by the tackle-block 5.

The first operation consists in raising the counter-jib 4, by the action of the tackle-block 6 and of the associated winch, to a given angle which corresponds to the cables of the tackle-block 5 being placed under tension. At that instant, continued action of the tackle-block causes the jib 3 and the counter-jib 4 to be raised simultaneously.

The braces 9 are then fixed to the counter-weight 7 which rests on the ground so that the counter-jib is subjected to the load of the counter-weight, constituting a couple which prevents it from pivoting. The tackle-block 6 thereafter ceases to perform any function.

Travel of the counter-weight over the ground, during rotational of translational movements of the crane, is brought about by placing the air cushions 78 under pressure. The counter-weight is thus raised from the ground, a gap, called the flight height, being produced between the cushions and the ground. If F is the force due to the load and applied at the upper end of the counter-jib and P is the force due to the counter-weight 7, the couple of the force P about axis 41 is greater than the couple of the force F about axis 41. The cushions have to lift a total load equal to $P - F \cos \alpha$, $\alpha$ being the angle formed by the tackle-block 5 with the vertical. Hence, the load to be raised by the air cushions increases as the force F applied by the load diminishes, and vice versa.

If the load diminishes without alteration to the air feed to the cushions, the counter-weight rises, the flight height increases and the rate of air leakage increases. It is thus necessary to provide means for varying the pressure prevailing in the air cushions in accordance with the couple on the crane, whether free from load or under load.

This can be achieved either by the crane driver or one of this assistants altering the pressure, or, in a more automatic system, as described above, by linking the air pressure to the couple of the load raised by the crane, using the overload controller with which the majority of tall cranes are now equipped.

Of course, it is possible, without going outside the scope of the invention, to conceive variants and detailed improvements and even to envisage the use of equivalent means.

What is claimed is:

1. A high-capacity crane comprising:

a carrier frame in contact with the ground; a structure which revolves on said frame about a vertical axis; a jib for raising a load and a counter-jib which respectively are articulated on said structure; a counterweight suspended from said counter-jib; said counterweight having a mass providing a greater couple then the maximum couple applied to said counter-jib by the hoisted load; air cushion means located beneath said counter-weight; means for regulating the pressure of air supplied to said air cushion means as a function of the couple applied to said counter-jib by the hoisted load; and a connecting frame articulated to said counter-weight and to said revolving structure

2. A crane according to claim 1, wherein means for regulating air pressure comprises: a force sensor mounted on braces connecting said counter-jib and said counter-weight for controlling an element which controls the air pressure to said air cushion means.

* * * * *